US011295920B2

(12) United States Patent
Villard et al.

(10) Patent No.: US 11,295,920 B2
(45) Date of Patent: Apr. 5, 2022

(54) FUSE HOLDING ELEMENT CONFIGURED TO RELEASIBLY COOPERATE WITH A CONDUCTING BAR

(71) Applicant: Tyco Electronics France SAS, Pontoise (FR)

(72) Inventors: Romain Villard, Pontoise (FR); Philippe France, Pontoise (FR); Yannick Villardier, Pontoise (FR)

(73) Assignee: Tyco Electronics France SAS, Pontoise (FR)

( * ) Notice: Subject to any disclaimer, the term of this patent is extended or adjusted under 35 U.S.C. 154(b) by 0 days.

(21) Appl. No.: 17/227,948

(22) Filed: Apr. 12, 2021

(65) Prior Publication Data

US 2021/0319968 A1 Oct. 14, 2021

(30) Foreign Application Priority Data

Apr. 14, 2020 (EP) ..... 20315161

(51) Int. Cl.
*H01H 85/20* (2006.01)
*H01R 13/68* (2011.01)

(52) U.S. Cl.
CPC ..... *H01H 85/203* (2013.01); *H01H 85/205* (2013.01); *H01R 13/68* (2013.01)

(58) Field of Classification Search
CPC .. H01H 85/202; H01H 85/203; H01H 85/205; H01H 2085/2055; H01R 13/68
See application file for complete search history.

(56) References Cited

U.S. PATENT DOCUMENTS

| | | | | |
|---|---|---|---|---|
| 4,432,594 | A * | 2/1984 | Daggett | H01H 85/205 439/698 |
| 4,472,018 | A * | 9/1984 | Urani | H01H 85/205 439/814 |
| 5,082,452 | A | 1/1992 | Takano | |
| 5,108,314 | A | 4/1992 | Takano | |
| 6,031,446 | A * | 2/2000 | Prohaska | H01H 9/10 337/214 |
| 9,991,611 | B1 * | 6/2018 | Jameson | H01H 85/202 |
| 2004/0018782 | A1 | 1/2004 | Antaya et al. | |
| 2007/0093089 | A1 * | 4/2007 | Ford | H01H 85/202 439/76.2 |
| 2013/0244508 | A1 * | 9/2013 | Taguchi | H01H 85/143 439/833 |
| 2018/0144899 | A1 * | 5/2018 | Sweeney | H01R 9/2416 |

FOREIGN PATENT DOCUMENTS

| | | |
|---|---|---|
| EP | 3136516 A1 | 3/2017 |
| GB | 2092398 A | 1/1982 |

OTHER PUBLICATIONS

European Search Report, dated Jan. 25, 2021, 3 pages.

* cited by examiner

*Primary Examiner* — Jacob R Crum
(74) *Attorney, Agent, or Firm* — Barley Snyder

(57) ABSTRACT

A fuse holding element includes a pair of holding branches facing each other and extending substantially parallel to a central plane of the fuse holding element and a linking part on which the holding branches are attached. The holding branches define a receiving location for a conducting end of a cylindrical fuse. The linking part has a fastener releasably cooperating with a complementary part of a conducting bar.

19 Claims, 2 Drawing Sheets

Fig. 1
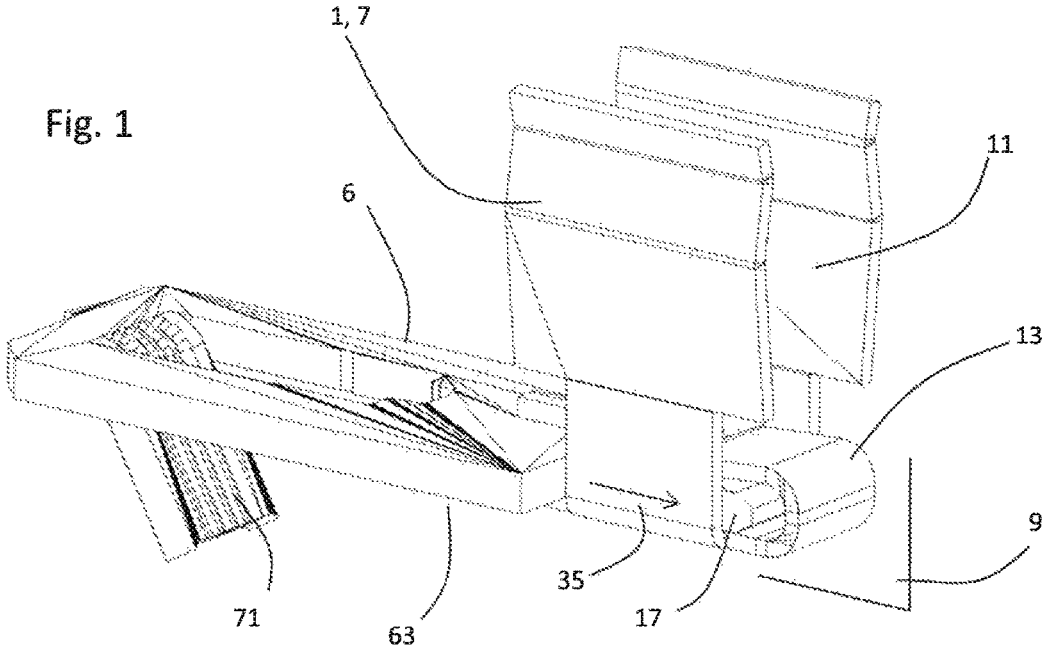
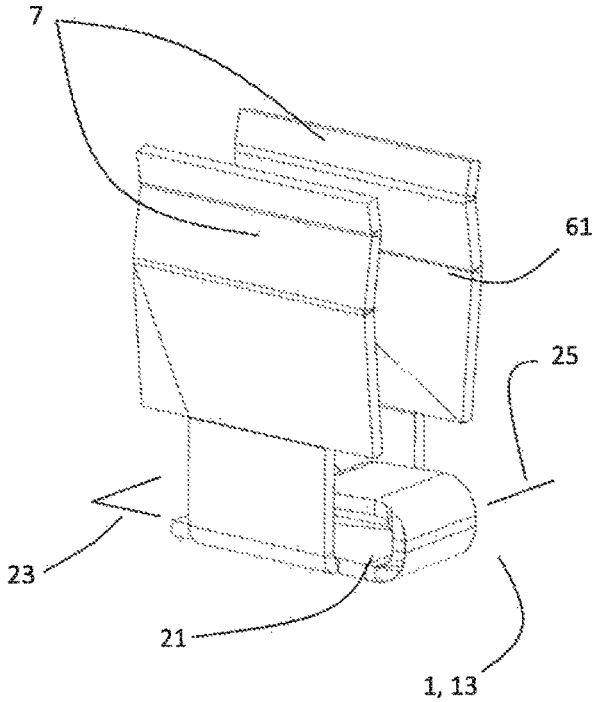
Fig. 2
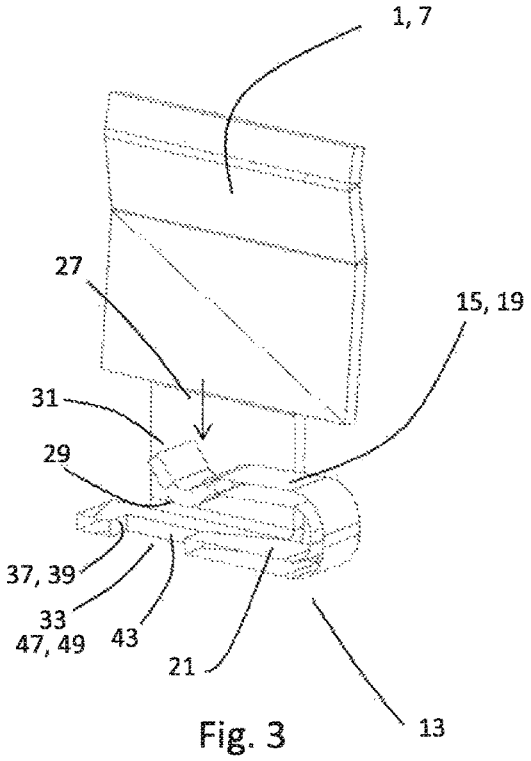
Fig. 3

Fig. 4
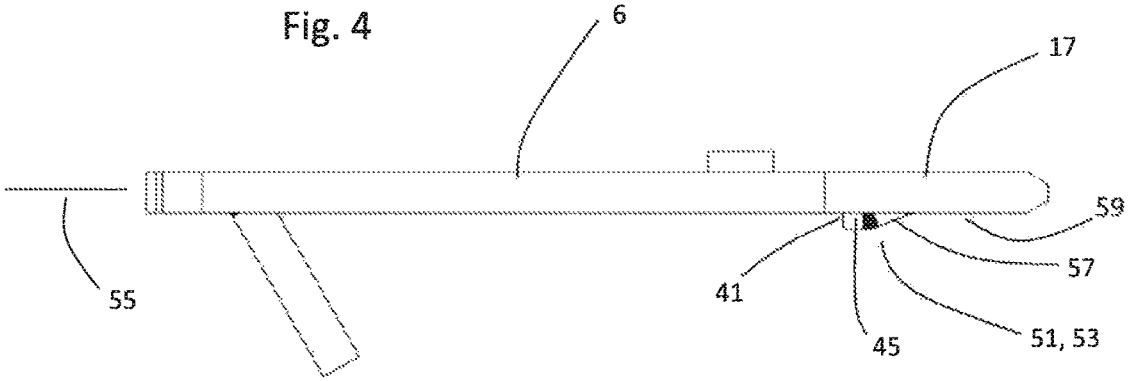
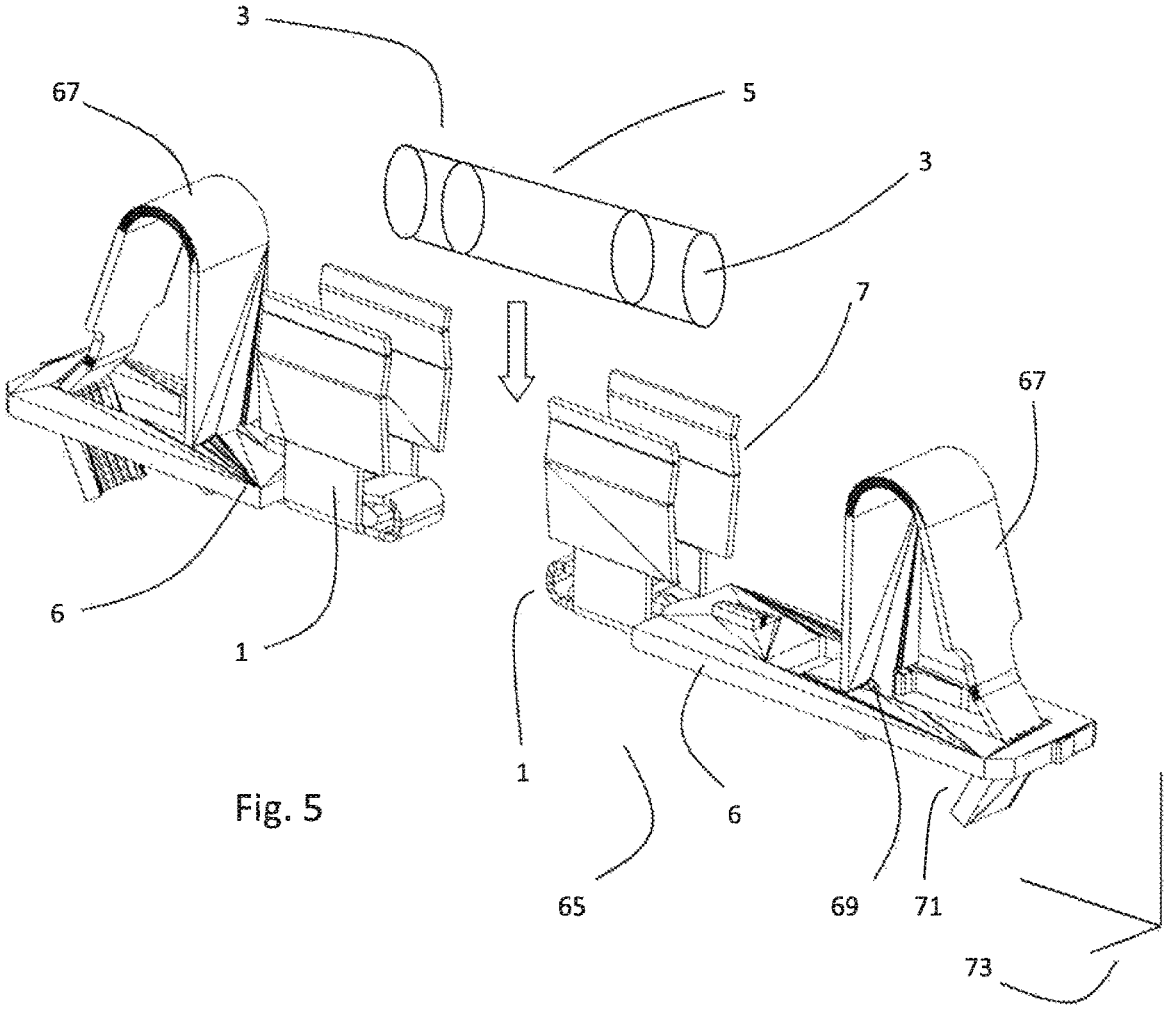
Fig. 5

FUSE HOLDING ELEMENT CONFIGURED TO RELEASIBLY COOPERATE WITH A CONDUCTING BAR

CROSS-REFERENCE TO RELATED APPLICATIONS

This application claims the benefit of the filing date under 35 U.S.C. § 119(a)-(d) of European Patent Application No. 20315161.8, filed on Apr. 14, 2020.

FIELD OF THE INVENTION

The present invention relates to a fuse holding element and, more particularly, to a fuse holding element configured to releasably cooperate with a conducting bar of a terminal block.

BACKGROUND

It is known to integrate a cylindrical fuse with conducting ends in a dedicated terminal block. The terminal block includes two fuse holding elements, each being dedicated to receive a conducting end of the cylindrical fuse. Each fuse holding element is fixed on a corresponding conducting bar, the conducting bar having another connection for an external conductor. The fuse holding elements are then intermediate conducting elements of the terminal block that enable releasably installing the cylindrical fuse in the terminal block.

Usually, each fuse holding element is fixed to the corresponding conducting bar with a mechanism such as rivets. The use of such a mechanism implies additional parts and labor cost, as the conducting bar and the fuse holding element should be fixed during the assembling process of the corresponding terminal block. There is also a need for a more compact solution for assembling the fuse holding element to the conducting bar.

SUMMARY

A fuse holding element includes a pair of holding branches facing each other and extending substantially parallel to a central plane of the fuse holding element and a linking part on which the holding branches are attached. The holding branches define a receiving location for a conducting end of a cylindrical fuse. The linking part has a fastener releasably cooperating with a complementary part of a conducting bar.

BRIEF DESCRIPTION OF THE DRAWINGS

The invention will now be described by way of example with reference to the accompanying Figures, of which:

FIG. 1 is a perspective view of a fuse holding element and a conducting bar in a cooperating position;

FIG. 2 is a perspective view of the fuse holding element;

FIG. 3 is a sectional perspective view of the fuse holding element;

FIG. 4 is a side view of the conducting bar; and

FIG. 5 is a perspective view of a fuse holding assembly.

DETAILED DESCRIPTION OF THE EMBODIMENT(S)

In the following detailed description of the figures, the same elements or the elements that are fulfilling identical functions may retain the same references so as to simplify the understanding of the invention. The different aspects defined herein that are not incompatible can be combined. Further, the invention is not limited to the embodiments described herein by way of example, but rather encompasses all the variants.

As shown in FIGS. 1-5, a fuse holding element 1 is configured to cooperate with a conducting end 3 of a cylindrical fuse 5 and with a conducting bar 6. The fuse holding element 1 has two holding branches 7 extending substantially parallel to a central plane 9 of the fuse holding element 1, the two holding branches 7 facing each other and defining a receiving location 11 for the conducting end 3.

The fuse holding element 1, as shown in FIGS. 1-3, has a linking part 13 on which the two holding branches 7 are attached. The linking part 13 has a fastener 15 configured to releasably cooperate with a complementary part 17 of the conducting bar 6. The fuse holding element 1 is obtained from a folded metal sheet in an embodiment; the two holding branches 7 each corresponding to a folded part of the metal sheet.

The fastener 15 has a spring arm 19 shown in FIG. 3 configured to cooperate with the complementary part 17 of the conducting bar 6 so as to maintain the complementary part 17 on a contact surface 21 of the linking part 13. The spring arm 19 corresponds to a folded part of the metal sheet. The contact surface 21 and/or the spring arm 19 is at least partially located between the two holding branches 7 according to an extension plane 23 of the contact surface 21, as shown in FIG. 2.

The contact surface 21 extends transversely to the central plane 9. The linking part 13 is configured so that the spring arm 19 is designed to rotate with respect to the rest of the linking part 13 according to a clamping axis 25, shown in FIG. 2, that is transverse to the central plane 9, shown in FIG. 1.

The spring arm 19 is configured to apply a constraint on the complementary part 17 of the conducting bar 6 according to a maintaining direction 27 shown in FIG. 3 that is transverse to the extension plane 23 of the contact surface 21. The spring arm 19 has a protuberance 29 designed to be in contact with the conducting bar 6. The spring arm 19 also has a lever 31 extending in an inverse direction compared to the protuberance 29. The lever 31 is designed to be moved by hand or with the help of a tool to move the spring arm 19 and release the cooperation between the linking part 13 and the conducting bar 6.

The linking part 13 includes a positioning arrangement 33 configured for defining a cooperating position with the conducting bar 6 in a form-fitting manner, as shown in FIGS. 1 and 5. The positioning arrangement 33 is configured to maintain the conducting bar 6 in the cooperating position with respect to the extension plane 23 of the contact surface 21. In other words, the position arrangement 33 is configured to prevent surface displacement of the conducting bar 6 with respect to the contact surface 21.

The fastener 15 and the positioning arrangement 33 define an insertion direction 35 of the conducting bar 6 for reaching the cooperating position, the positioning arrangement 33 including a non-return part 37 configured to prevent a withdrawal according to the insertion direction 35, as shown in FIGS. 1 and 3. In other words, the insertion direction 35 defines a direction of movement for the conducting bar 6 to the cooperating position and the non-return part 37 prevents a withdrawal in the opposite direction. The insertion direction 35 extends parallel to the extension plane 23 of the contact surface 21. In an embodiment, the insertion direction 35 is transverse to the clamping axis 25.

The non-return part 37 has a blocking surface 39, shown in FIG. 3, extending transversely to the insertion direction 35 and configured to cooperate with a complementary blocking surface 41 of the conducting bar 6, shown in FIG. 4, in the cooperating position. The positioning arrangement 33 presents at least one lateral surface 43 extending substantially parallel to the central plane 9 and configured to cooperate with a corresponding complementary lateral surface 45 of the conducting bar 6 in the cooperating position. The at least one lateral surface 43 is transverse to the blocking surface 39. In particular, the at least one lateral surface 43 is configured to prevent a lateral displacement of the conducting bar 6 with respect to the linking part 13 in cooperating position.

The positioning arrangement 33 has a transverse shifting device 47, shown in FIG. 3, configured to shift the conducting bar 6 with respect to the contact surface 21 transversely to the insertion direction 35 during insertion, so as to have the blocking surface 39 cooperating with the complementary blocking surface 41 in the cooperating position. The transverse shifting device 47 is an opening 49 in the linking part 13 extending transversely to the insertion direction 35. The blocking surface 39 and/or the at least one lateral surface 43 correspond to a contour part of the opening 49. In an embodiment, the opening 49 is a through opening.

As shown in FIG. 4, the conducting bar 6 has a complementary positioning arrangement 51 configured to cooperate with the positioning arrangement 33. In an embodiment, the complementary positioning arrangement 51 has a protrusion 53 extending transversely to a longitudinal plane 55 along which the conducting bar 6 is extending. The complementary blocking surface 41 and/or the at least one complementary lateral surface 45 are formed on the protrusion 53. In an embodiment, the protrusion 53 has a sloped surface 57 extending from a basis surface 59 of the conducting bar 6 to an apex of the protrusion 53. The basis surface 59 of the conducting bar 6 is arranged for cooperating with the contact surface 21 in the cooperating position. It is also possible to switch the protrusion 53 and the opening 49 to obtain the same positioning effect of the conducting bar 6 with respect to the linking part 13.

As shown in FIG. 2, each of the two holding branches 7 has a profiled cavity 61 adapted to accommodate a part of the conducting end 3 of the cylindrical fuse 5. The profiled cavity 61 is engendered by at least one folding of the corresponding holding branch 7. In an embodiment, the two holding branches 7 are configured to be in electrical contact with the conducting end 3 of the cylindrical fuse 5.

As shown in FIG. 1, a part assembly 63 includes the fuse holding element 1 and the conducting bar 6.

As shown in FIG. 5, a fuse holding assembly 65 configured for receiving the cylindrical fuse 5 has two fuse holding elements 1. The two central planes 9 of the fuse holding elements 1 coincide so that each fuse holding element 1 is configured to accommodate one conducting end 3 of the cylindrical fuse 5. The fuse holding assembly 65 has two conducting bars 6, each being configured to cooperate with a corresponding fuse holding element 1, the fuse holding assembly 65 being configured to electrically connect the two conducting bars 6 via the cylindrical fuse 5 when the cylindrical fuse 5 has both conducting ends 3 connected to a corresponding fuse holding element 1.

Each conducting bar 6 is arranged in the fuse holding assembly 65 to be connected to a corresponding external conductor. In the embodiment shown in FIG. 5, the fuse holding assembly 65 has at least one leaf spring 67 for maintaining the external conductor on the corresponding conducting bar 6. The corresponding conducting bar 6 has an accommodating area 69 for the leaf spring 67 and a cooperation area 71 on which the external conductor is designed to be maintained.

In an embodiment, a terminal block 73, which is schematically represented in FIG. 5, can comprise the fuse holding assembly 65.

The above-described features enable a good position maintaining in the cooperating position that is equivalent to the use of a rivet or equivalent fixing devices. They also enable an easy insertion as the sloped surface 57 prevents any blocking during insertion. The number of parts is low and, correspondingly, the cost of the fuse holding element 1 and conducting bar 6 is reduced. In addition, the construction is compact. The mounting process is simplified as the fuse holding element 1 can be assembled by hand with the connecting bar 6.

What is claimed is:

1. A fuse holding element, comprising:

a pair of holding branches facing each other and extending substantially parallel to a central plane of the fuse holding element, the holding branches defining a receiving location for a conducting end of a cylindrical fuse; and a linking part on which the holding branches are attached, the linking part having a fastener releasably cooperating with a complementary part of a conducting bar, the fastener has a spring arm cooperating with the complementary part of the conducting bar, the spring arm extends over a contact surface of the linking part and between the holding branches.

2. The fuse holding element of claim 1, wherein the spring arm maintains the complementary part on the contact surface of the linking part.

3. The fuse holding element of claim 2, wherein the contact surface extends transversely to the central plane.

4. The fuse holding element of claim 1, wherein the linking part has a positioning arrangement defining a cooperating position with the conducting bar in a form-fitting manner.

5. The fuse holding element of claim 4, wherein the fastener and the positioning arrangement define an insertion direction of the conducting bar for reaching the cooperating position.

6. The fuse holding element of claim 5, wherein the positioning arrangement has a non-return part preventing a withdrawal of the conductor bar opposite to the insertion direction.

7. The fuse holding element of claim 6, wherein the non-return part has a blocking surface extending transversely to the insertion direction and cooperating with a complementary blocking surface of the conducting bar in the cooperating position.

8. The fuse holding element of claim 7, wherein the positioning arrangement has a transverse shifting device shifting the conducting bar with respect to the contact surface transversely to the insertion direction.

9. The fuse holding element of claim 8, wherein the transverse shifting device is an opening in the linking part extending transversely to the insertion direction.

10. The fuse holding element of claim 1, wherein each of the holding branches has a profiled cavity accommodating a part of the conducting end of the cylindrical fuse.

11. A fuse holding assembly, comprising:

a pair of fuse holding elements each including a pair of holding branches facing each other and extending substantially parallel to a central plane of the fuse holding element, and a linking part on which the holding branches are attached, the linking part has a fastener with a spring arm extending over a contact surface of the linking part and between the holding branches, the central planes of the fuse holding elements coincide so that each fuse holding element accommodates one of a pair of conducting ends of a cylindrical fuse.

12. The fuse holding assembly of claim 11, further comprising a pair of conducting bars each cooperating with one of the fuse holding elements.

13. The fuse holding assembly of claim 12, wherein the fuse holding assembly electrically connects the conducting bars via the cylindrical fuse when the conducting ends of the cylindrical fuse are connected to the fuse holding elements.

14. A terminal block, comprising:

a fuse holding assembly including a pair of fuse holding elements each having a pair of holding branches facing each other and extending substantially parallel to a central plane of the fuse holding element, and a linking part on which the holding branches are attached, the linking part has a fastener with a spring arm extending over a contact surface of the linking part and between the holding branches, the central planes of the fuse holding elements coincide so that each fuse holding element accommodates one of a pair of conducting ends of a cylindrical fuse.

15. The fuse holding element of claim 2, wherein the spring arm applies a force on the complementary part in a maintaining direction toward the contact surface of the linking part.

16. The fuse holding element of claim 1, wherein the spring arm has a protuberance extending toward the contact surface.

17. The fuse holding element of claim 16, wherein the spring arm has a lever at an end of the spring arm and extending in an inverse direction compared to the protuberance.

18. The fuse holding element of claim 1, wherein the spring arm is disposed within the receiving location.

19. The fuse holding assembly of claim 12, wherein the fastener of the linking part of each of the fuse holding elements releasibly cooperates with a complementary part of one of the conducting bars.

* * * * *